US005552975A

United States Patent [19]

Ho

[11] Patent Number: 5,552,975

[45] Date of Patent: Sep. 3, 1996

[54] ILLUSIVE LAMP

[76] Inventor: Chen C. Ho, P.O. Box 82-144, Taipei, Taiwan

[21] Appl. No.: 331,708

[22] Filed: Oct. 31, 1994

[51] Int. Cl.[6] ..... F21V 17/02

[52] U.S. Cl. ..... 362/324; 362/35; 362/806; 362/811

[58] Field of Search ..... 362/35, 253, 284, 362/324, 351, 356, 806, 811, 812, 300, 319

[56] References Cited

U.S. PATENT DOCUMENTS

| | | | |
|---|---|---|---|
| 1,619,198 | 3/1927 | Edison | 362/35 |
| 2,398,974 | 4/1946 | Storm | 362/35 |
| 3,531,636 | 9/1970 | Birch | 362/811 |
| 3,701,897 | 10/1972 | Pennington et al. | 362/811 |

FOREIGN PATENT DOCUMENTS

| | | | |
|---|---|---|---|
| 3718369 | 12/1988 | Germany | 362/35 |

*Primary Examiner*—Denise L. Gromada
*Assistant Examiner*—Y. Quach
*Attorney, Agent, or Firm*—Alfred Lei

[57] ABSTRACT

An illusive lamp including a cylindrical shade having a vertical surface provided with a plurality of holes with different shapes, a spherical housing having a plurality of protuberances with different colors on a top and a tubular portion at a lower end, the spherical housing being fixedly mounted in said cylindrical shade, and a rotating seat having a base, a motor mounted the base, a gear connected with an output axle of the motor, an electrical socket mounted on the base, a collar having a pinion fixedly mounted on a bottom thereof and engaged with the gear, a light bulb fitted in the electrical socket, and a cover mounted on the base, the tubular portion of the spherical housing being fixedly fitted in said collar.

1 Claim, 6 Drawing Sheets

ILLUSIVE LAMP

BACKGROUND OF THE INVENTION

It has been found that the neon lamp developed in 1911 has been largely used in commercial signs. However, the neon lamp cannot provide many kinds variations and so it will become dull in a short time.

Therefore, it is an object of the present invention to provide an illusive lamp which can obviate and mitigate the above-mentioned drawback.

SUMMARY OF THE INVENTION

This invention relates to an illusive lamp.

It is the primary object of the present invention to provide an illusive lamp which will give fascinating colorful light.

It is another object of the present invention to provide an illusive lamp which has strong charm and attraction.

It is still another object of the present invention to provide an illusive lamp which will reflect various images.

It is still another object of the present invention to provide an illusive lamp which is easy to assemble.

It is a further object of the present invention to provide an illusive lamp which is low in cost.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
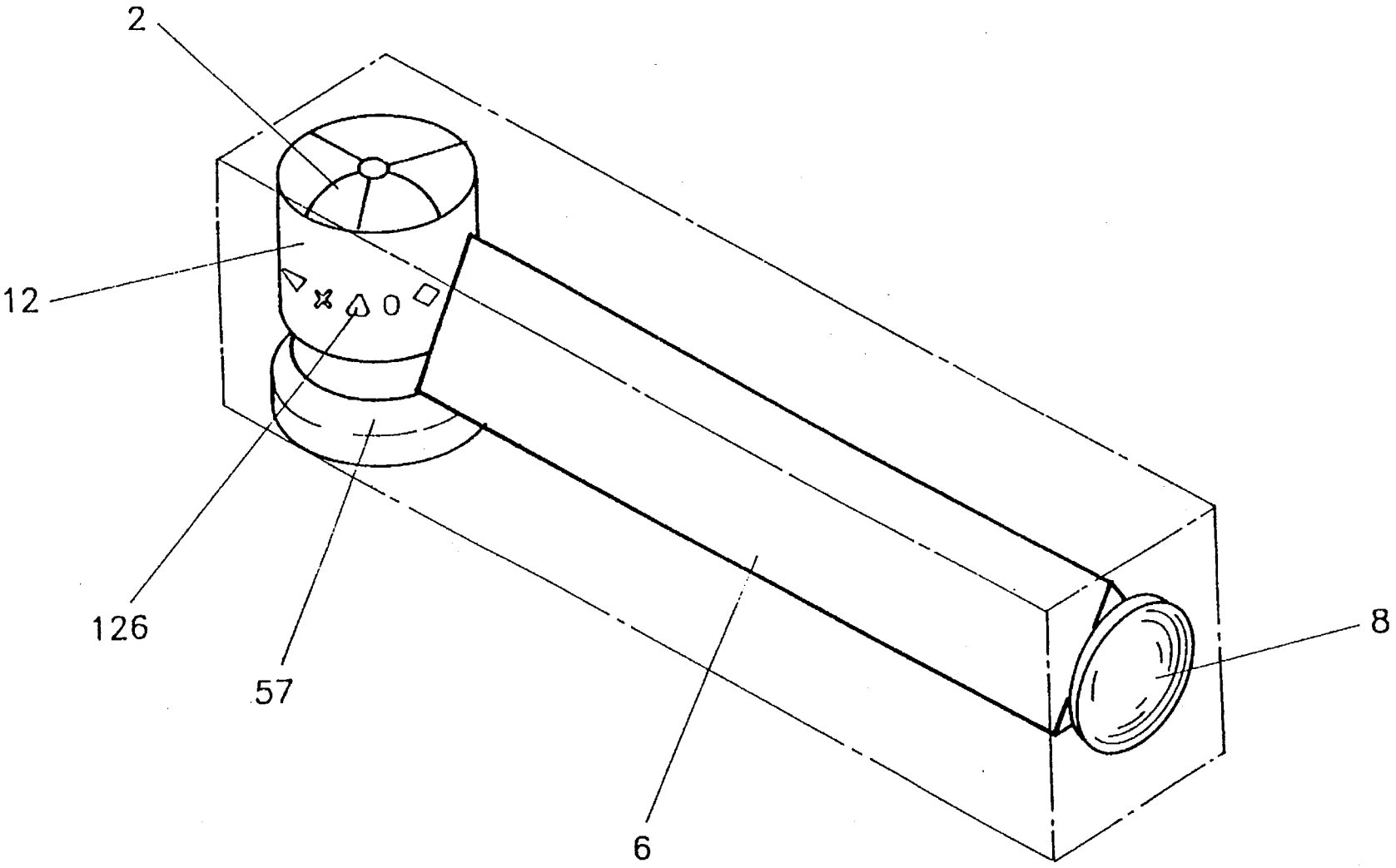
FIG. 1 is a perspective view of the present invention.
Figure 2:
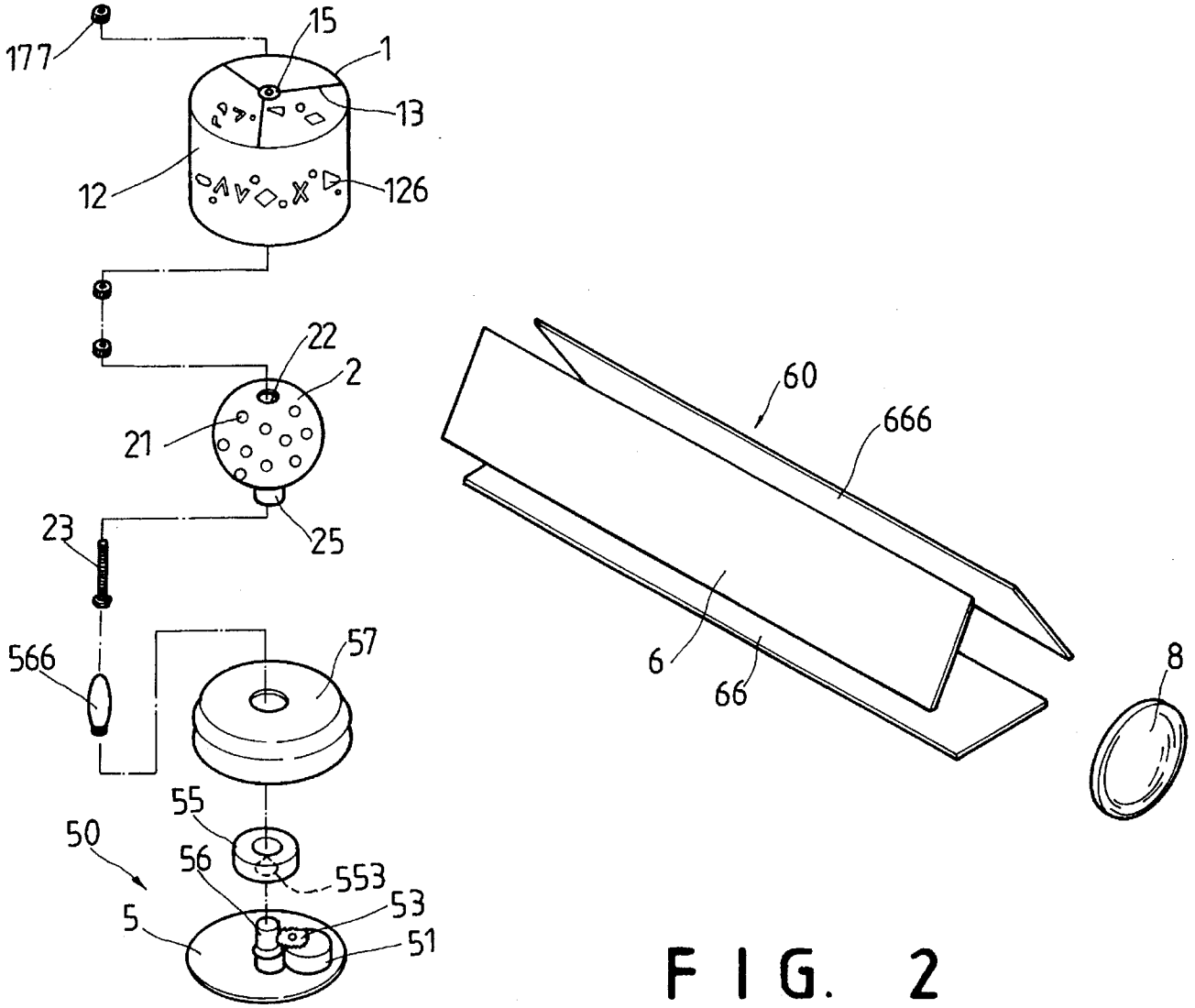
FIG. 2 is an exploded view of the present invention.
Figure 3:
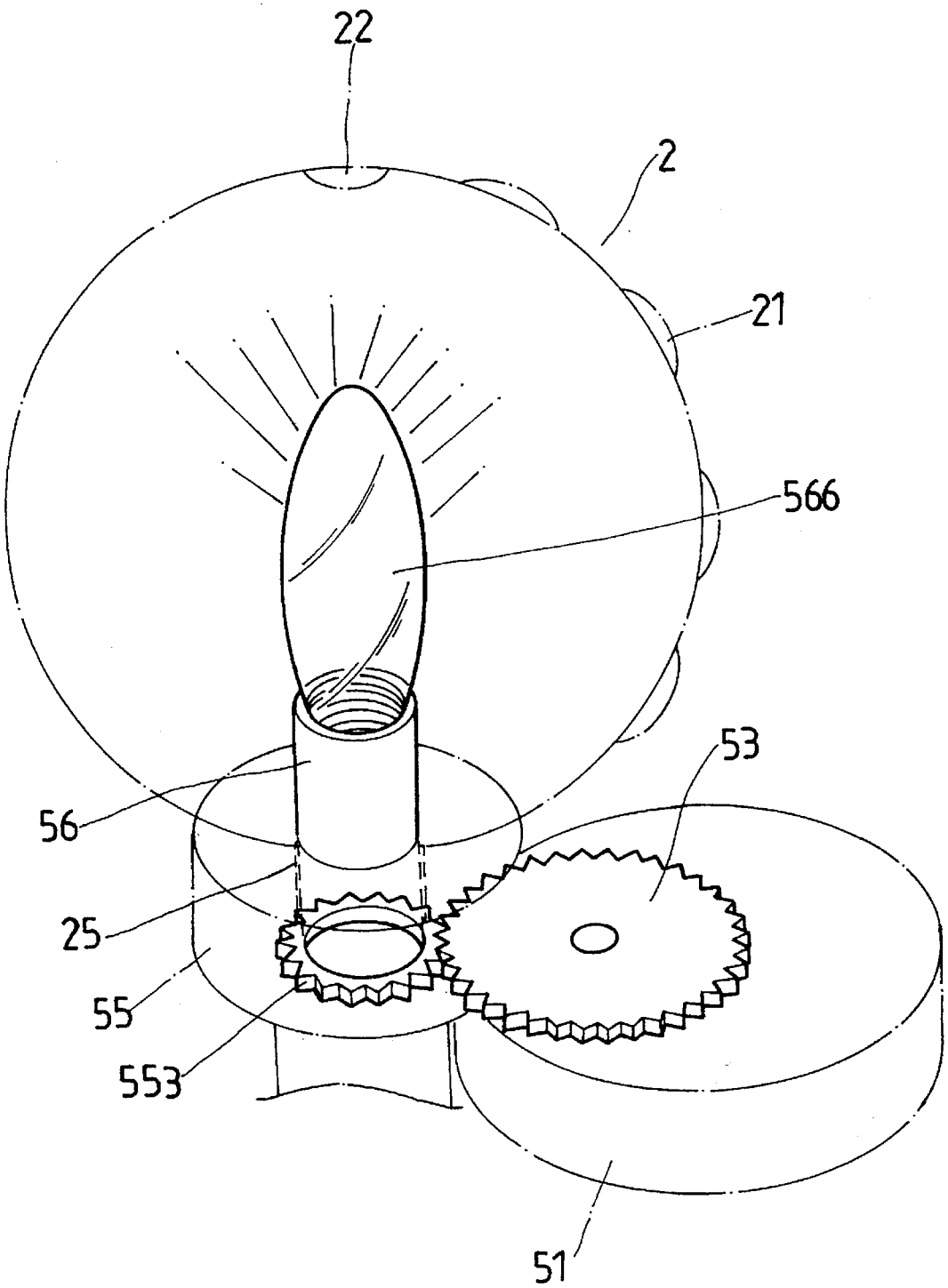
FIG. 3 is an enlarged fragmentary view of the present invention.
Figure 4:
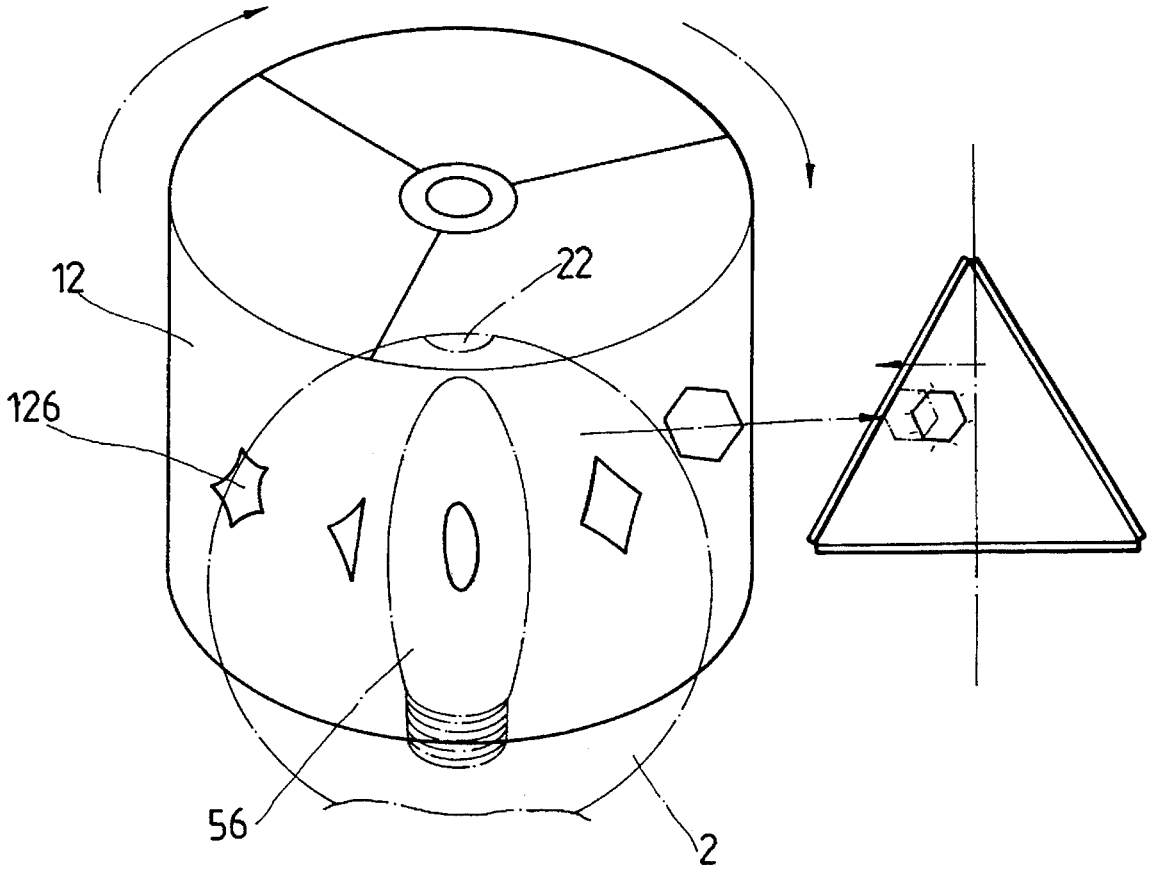
FIGS. 4, 5, 6 and 7 shows the working principle of the present invention.
Figure 6:
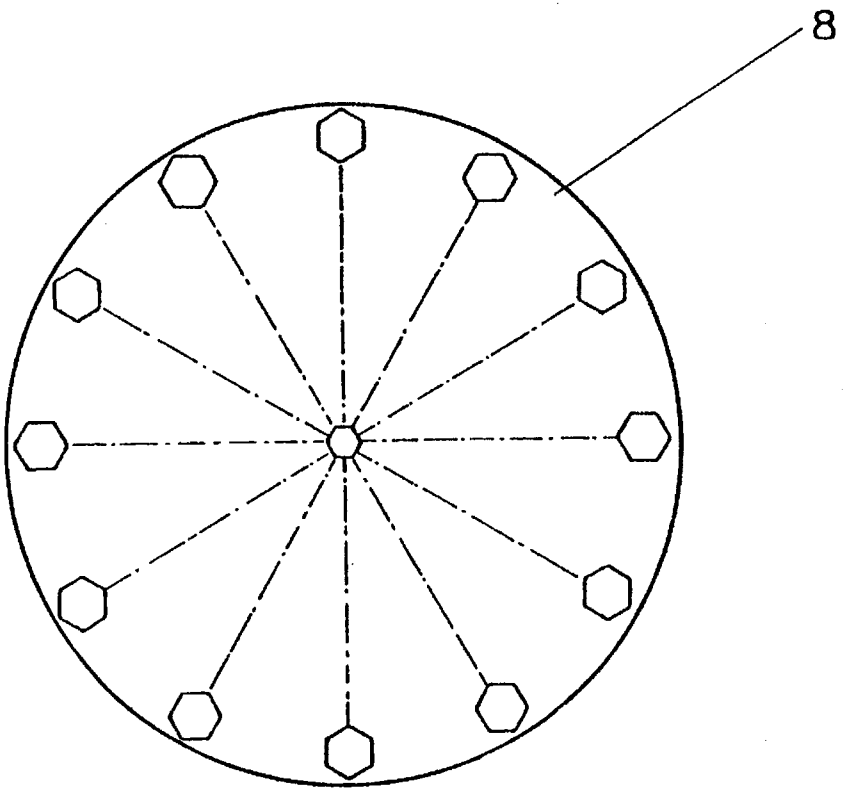
Figure 5:
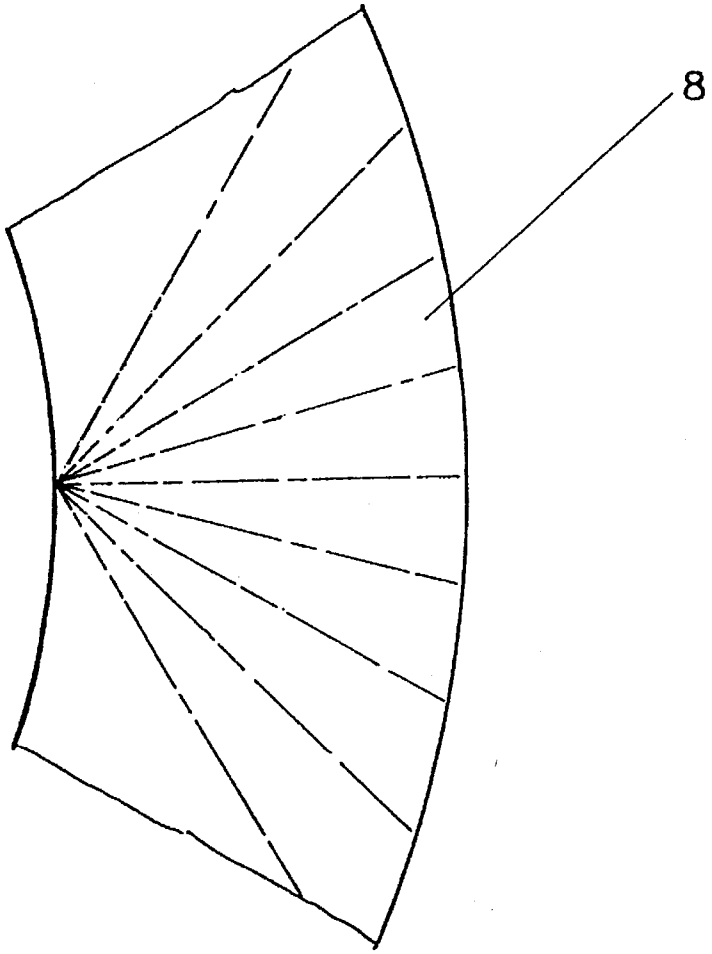
Figures 7, 8:
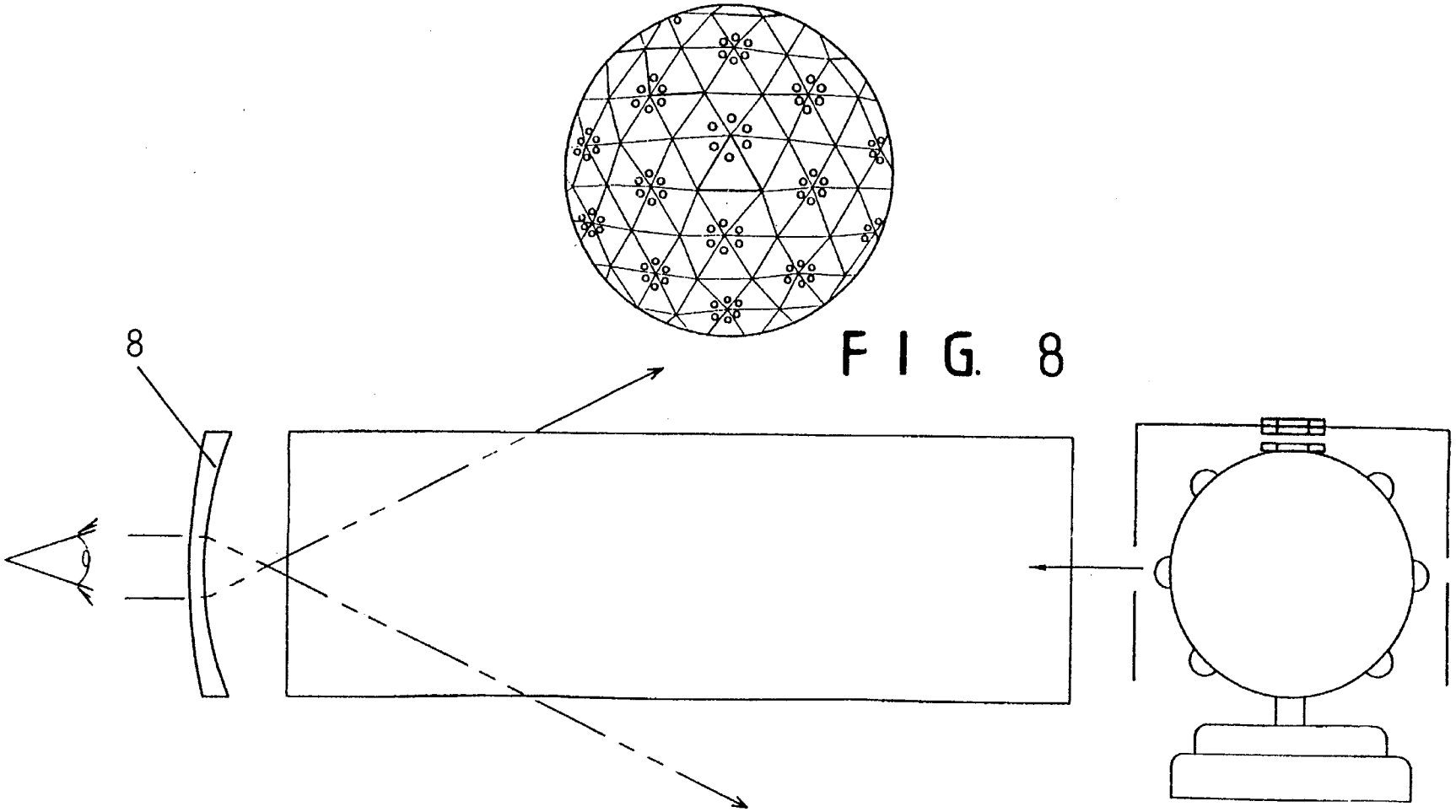
FIG. 8 shows an image obtained from the present invention.

With reference to the drawings and in particular to FIGS. 1, 2 and 3 thereof, the illusive lamp according to the present invention mainly comprises a cylindrical shade 1, a spherical housing 2, a rotating seat 50, a triangular mirror assembly 60, and a lens 8.

The cylindrical shade 1 includes a vertical surface 12 provided with a plurality of holes 126 with different shapes and a plurality of radial supporting wires 13 fitted on the top thereof. A ring member 15 is mounted at the central portion of the top of the cylindrical shade 1 and connected with the inner ends of the supporting wires 13.

The spherical housing 2 has an opening 22 at the top, a plurality of protuberances 21 with different colors and a tubular portion 25 at the lower end. The spherical housing 2 is disposed within the cylindrical shade 1 and fixedly connected to the cylindrical shade 1 by a bolt 23 extending upwardly through the opening 22 of the spherical housing 2 to connect the ring member 15 of the cylindrical shade 1 by a nut 177.

The rotating seat 50 includes a base 5, a motor 51 mounted on the base 5, a gear 53 connected with an output axle of the motor 51, an electrical socket 56 mounted at the central portion of the base 5, a collar 55 having a pinion 553 fixedly mounted on the bottom of the collar 55 and engaged with the gear 53, a light bulb 566 fitted in the electrical socket 56, and a cover 57 mounted on the base 5. The tubular portion 25 of the spherical housing 2 is fixedly fitted in the collar 55 so that the spherical housing 2 together with the cylindrical shape 1 will be rotated with the collar 55.

FIGS. 4, 5, 6 and 7 shows the working principle of the present invention. FIG. 8 shows an image obtained from the present invention.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An illusive lamp comprising:

a rotating seat having a base, a motor mounted on the base, a gear connected with an output axle of the motor, a collar having a pinion fixedly mounted on a bottom of the collar with respect to the base and engaged with the gear, an electrical socket mounted on the base and extending upwardly with respect to the base through the collar, a light bulb fitted in the electrical socket and extending through an opening in a cover mounted on the base;

a cylindrical shade having a vertical surface with respect to the base provided with a plurality of holes with different shapes;

a spherical housing having a plurality of protuberances with different colors on a top portion of the spherical housing with respect to the base and a tubular neck portion at a lower portion of the spherical housing with respect to the base, said tubular neck portion extending through the opening and being fixedly fitted in said collar and enclosing said electrical socket, said spherical housing being fixedly mounted in said cylindrical shade;

a triangular mirror assembly having a first end and a second end arranged beside said cylindrical shade; and a lens disposed at said first end of said triangular mirror assembly.

* * * * *